United States Patent [19]

Johnson

[11] Patent Number: 4,716,749

[45] Date of Patent: Jan. 5, 1988

[54] HIGH SECURITY PIN TUMBLER LOCK

[75] Inventor: Gale Johnson, Northbrook, Ill.

[73] Assignee: Fort Lock Corporation, River Grove, Ill.

[21] Appl. No.: 3,813

[22] Filed: Jan. 16, 1987

[51] Int. Cl.[4] ..... E05B 27/08

[52] U.S. Cl. ..... 70/363; 70/378

[58] Field of Search ..... 70/363, 376, 378, 419

[56] References Cited

U.S. PATENT DOCUMENTS

| | | | |
|---|---|---|---|
| 2,202,329 | 5/1940 | Braune | 70/419 |
| 2,283,489 | 5/1942 | Crousore | 70/419 |
| 2,629,249 | 2/1953 | Mendelsohn | 70/419 |
| 3,681,955 | 8/1972 | Sturgeon | 70/363 |
| 4,041,739 | 8/1977 | Mercurio | 70/363 |
| 4,546,629 | 10/1985 | Hwang | 70/363 |

*Primary Examiner*—Robert L. Wolfe

*Attorney, Agent, or Firm*—Leydig, Voit & Mayer

[57] ABSTRACT

An improved, highly pick-resistant tumbler lock construction incorporates annular undercut portions on both the rotating spindle and the tumbler sleeve of the lock. The undercut portions define discontinuities along the axial bores of the spindle and the tumbler sleeve so as to provide the false feel of a shear plane when the driver pins are used to manipulate the tumbler pins in order to pick or decode the lock. Several of the driver pins and the tumbler pins are also provided with annular grooves which, in combination with the undercuts on the spindle and tumbler sleeve, accentuate the false feel effect in such a way that the false feel of the shear plane is provided at differently inwardly extending positions of the pins, thereby making it extremely difficult to determine when a particular tumbler pin has been precisely positioned at the shear plane.

6 Claims, 5 Drawing Figures

HIGH SECURITY PIN TUMBLER LOCK

BACKGROUND OF THE INVENTION

The present invention relates generally to tumbler locks and, more particularly, relates to an improved type of construction for pin tumbler locks which offers a heightened degree of resistance to picking.

FIELD OF THE INVENTION

A variety of tumbler locks, such as the well-known axial pin tubular locks, are currently available and are frequently used in applications such as vending, dispensing machines which are installed in locations susceptible to picking attempts and other forms of surreptitious entry. It hence is a primary concern to design such tumbler locks in a fashion making them highly resistant to picking attempts.

Axial pin tubular locks, for instance, are conventionally based upon a design including a tubular sleeve within which a locking spindle is rotatably mounted and is normally prevented from rotation by axially movable tumbler pins which extend between the sleeve and an adjacent rigidly anchored driver spindle. The driver pins are usually of different lengths and, when actuated by using a proper key, axially displace the tumbler pins through different predetermined distances in such a manner that all the tumbler pins are precisely aligned at the shear plane between the locking spindle and the tumbler sleeve, thereby permitting the locking spindles to turn and bring about the locking action.

Although the use of several pins of different lengths provides such conventional tumbler locks with reasonable pick-resistant qualities, these locks can be picked by the use of small, specially shaped tools or probes that can be inserted into the keyway and used to manipulate the driver pins against corresponding tumbler pins so as to lock the driver pins against the tumbler pin edges due to the slight lateral movement or "give" available at the shear plane. This allows the locking spindle and hence the lock mechanism itself to rotate thereby defeating the tumbler lock. Many conventional tumbler locks are also susceptible to decoding techniques in which thin elongated tools are used to move the tumbler pins so as to determine by feel the position of each tumbler pin when it is at the shear line or otherwise at the spindle-rotating position.

Some tumbler locks utilized grooves defined on the tumbler pins that bind with corresponding flanges defined internally on the cylinder body of the lock when picking is attempted. Such locks generally necessitate complicated design and construction of the cylindrical lock body. For instance, the Huck Pin lock from Builders Hardware Industries incorporates a series of lands and grooves around some of the lower portion of the top pins and the upper top portion of the some of the lower pins which cause the pins to bind on a flange surrounding the lower portion of the cylinder pin housing when the lock is subjected to a picking attempt. (See Self et al., Technical Memorandum No. M-64-79-02, Naval Construction Battalion Center, Calif., pp. 11,12.)

Other tumbler locks, such as those using side bar engagement or rim and mortise cylinders, do provide increased pick resistance but incorporate complex locking mechanisms which invariably add substantially to the overall cost.

SUMMARY OF THE INVENTION

It is the general aim of the present invention to provide an improved tumbler lock construction which is highly resistant to picking attempts.

A related object is to provide an improved tumbler lock which is based on an uncomplicated locking mechanism and which can be economically manufactured.

It is a further object of this invention to provide an improved pin tumbler lock of the above type which is substantially of the same size and comprises about the same number of mechanical components as conventional tumbler locks.

These and other objects of this invention are realized by providing both the rotating spindle and the tumbler sleeve with annular undercut portions essentially providing the false feel of a shear plane as the driver pins are used to manipulate the tumbler pins in order to pick the lock. In addition, several of the driver pins, as well as the tumbler pins themselves, are provided with annular undercuts which, in combination with the undercuts on the spindle and tumbler sleeve, accentuate the false feel effect. The different lengths of the driver pins in effect cause the undercuts on the driver and tumbler pins to co-act with the undercuts on the spindle and tumbler sleeve in such a way that the false feel is provided at different inwardly extending positions of the driver pins, thereby making it practically impossible to determine when a particular tumbler pin has been precisely positioned at the shear plane.

The illustrative lock construction is uncomplicated and economical and can easily be incorporated into the design of conventional pin tumbler locks.

BRIEF DESCRIPTION OF THE DRAWINGS

The invention and further objects and advantages thereof will be made apparent by reference to the ensuing description when taken in conjunction with the accompanying drawings, wherein.

DESCRIPTION OF THE PREFERRED EMBODIMENT

Figure 1:
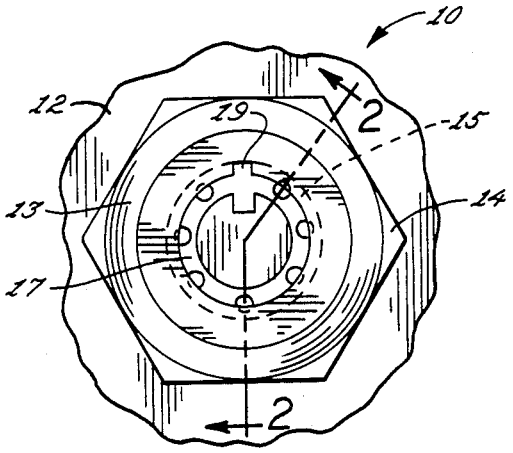
FIG. 1 is a front elevational view of a tubular axial pin tumbler lock constructed according to the preferred embodiment of this invention.

Referring collectively now to drawings 1–3, there is shown an axial pin tumbler lock construction in accordance with a preferred embodiment of this invention. The tumbler lock includes an outer tubular body 11 which is adapted to be threaded into a support member 12 and includes a frustoconical head 13. A washer 14 is interspersed between the member 12 and the lock head 13 and functions to mount the lock assembly rigidly onto the mounting surface. A stationary tumbler sleeve 15 telescopes into and is rigidly anchored within the rear end of the tubular body 11. An elongated spindle 16 is rotatably supported in the tumbler sleeve 15 and extends through the lock body. A driver pin sleeve 17 is located at the forward end of the rotating spindle 16 and a locking member 18 is fastened into position after being inserted through the cross-section of the rear end of the spindle 16.

Actual locking and unlocking action of the lock is brought about by the rotating motion of the spindle which in turn causes the locking member 18 to move between a locked and unlocked position. Rotational movement of the spindle 16 is normally effected by using a key (not shown) adapted to fit into the frutsoconical head 13 over the spindle and having a tab which aligns with a keyway 19 provided on the head of the lock.

Figure 2:
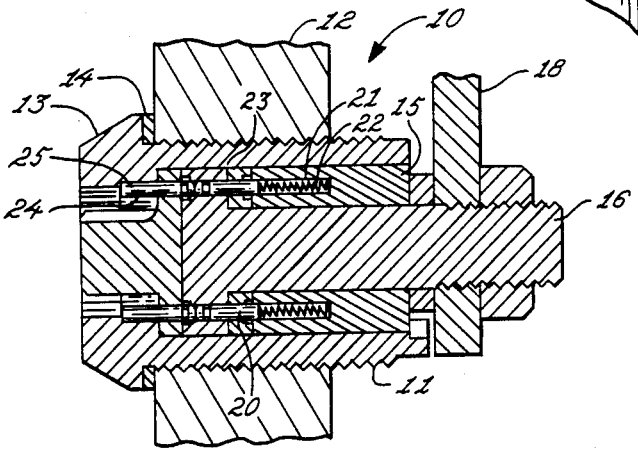
FIG. 2 is a cross-sectional view taken substantially along the line 2—2 of FIG. 1.
Figure 3:
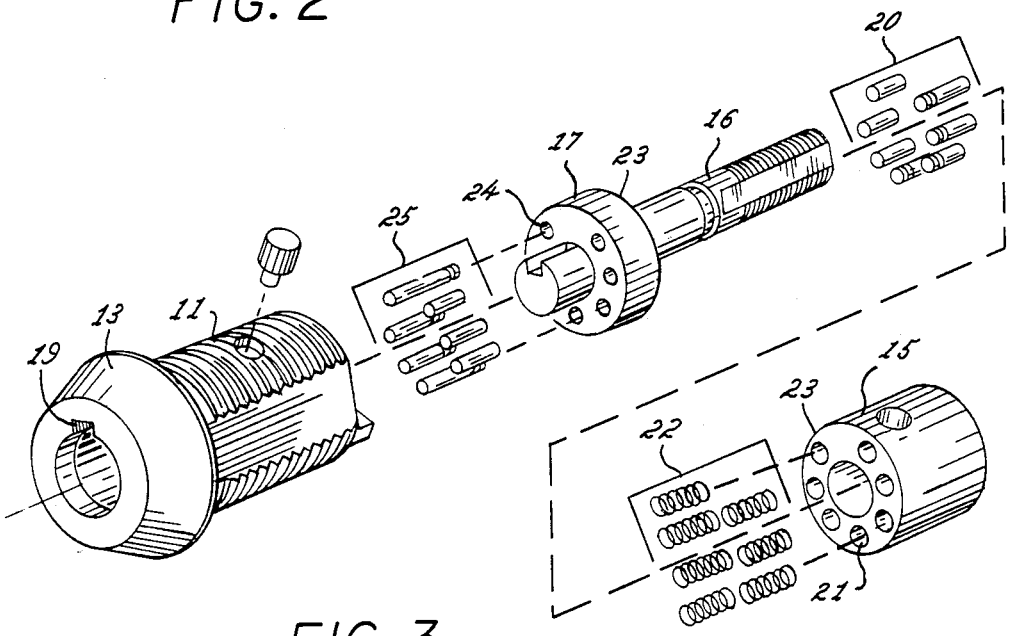
FIG. 3 is an exploded perspective view of certain important components of the tumbler lock according to the preferred embodiment of this invention.

A series of angularly spaced tumbler pins 20 (FIGS. 2 and 3) are slidably positioned within bores 21 defined through the tumbler sleeve 15 and function to normally retain the spindle 16 in its locked position wherein rotational motion is prohibited. The tumbler pins 20 are invariably urged forward by means of coiled compression springs 22 disposed within the bores 21 which retain the pins. Under the urging of the springs 22, the tumbler pins 20 are disposed along the bores 21 in such a manner that the outer ends of the pins normally project outward beyond the shear plane 23 formed at the interface of the tumbler sleeve 15 and the driver sleeve 17 and into corresponding bores 24 defined through the driver sleeve. In this normal position, the tumbler pins lock the driver sleeve 17 and the spindle 16 against rotational motion relative to the tumbler sleeve 15.

However, such rotational motion is permitted if the tumbler pins are displaced rearwardly against the urging of the compression springs in such a fashion that the forward ends of all the tumbler pins lie exactly at the sheer plane 23. This rearward displacement of the tumbler pins is effected by driver pins 25 positioned in an axially slidable manner within the bores 24 of the driver sleeve in such a way that the inner ends of the driver pins engage with the outer ends of the corresponding tumbler pins. Generally, at least some of the driver pins are of different lengths so that alignment of all tumbler pins at the sheer plane necessarily requires the displacement of different driver pins by different predetermined distances. This requires the use of a properly coded key to displace the driver pins through the predetermined distances in order to cause the rear ends of all of the tumbler pins to be simultaneously aligned at the sheer plane so that the spindle may be rotated. Coding of such conventional tumbler locks is accomplished by placing driver pins 25 of different lengths inside predetermined ones of the bores 24 defined in the driver sleeve 17.

The tumbler lock described so far is fairly conventional and can be picked by inserting a thin flexible probe through one of the bores of the driver sleeve in order to push the driver pin disposed therein, and consequently the corresponding tumbler pin backward while simultaneously applying a slight twisting force to the driver spindle and feeling for the slight edge presented by the junction of the driver pin and the tumbler pin at the shear plane and then gently locking the driver pin in this position. Even if it is not possible to pick the lock by locking the driver pin at the sheer plane, it is possible to decode the lock by estimating the length of a particular driver pin by carefully feeling for the edge or slight "give" resulting from the movement of the head of the driver pin in the immediate vicinity of the shear plane. The locking mechanism of such tumbler locks can hence be defeated by repeating the above procedure on the rest of the driver pins.

According to a unique feature of this invention, increased resistance to such attempts at picking or decoding the locking mechanism is made possible by constructing the locking components in such a way that a series of false feels or indications of the existence of the shear plane are provided as the driver pins are pushed backward in an attempt to pick the lock.

More specifically, the rotating spindle and the tumble sleeve are provided with annular undercut portions which cooperate with annular grooves defined on several of the driver and tumbler pins to provide a series of false "feels" falsely indicative of the presence of the shear plane, thereby making it virtually impossible to determine the true location of the shear plane as the driver pins and tumbler pins are manipulated in a lock picking attempt. This novel construction, according to the system of this invention, is clearly illustrated in FIG. 4 which is an isolated cross-sectional view clearly illustrating the undercuts along the axial length of the spindle and tumbler bores. As shown, the driver sleeve 16 carried on the spindle 17 is provided with an annular undercut 26 disposed along the spindle end proximate to the shear plane 23. A similar annular undercut 27 is also provided on the tumbler sleeve 15 on its end proximate to the shear plane. When the spindle 17 and the tumbler sleeve 15 are axially joined as part of the lock assembly, the undercuts 26 and 27 present discontinuities along the generally cylindrical length of the driver pin bores 24 and the tumbler pin bores 21, respectively.

Figure 4:
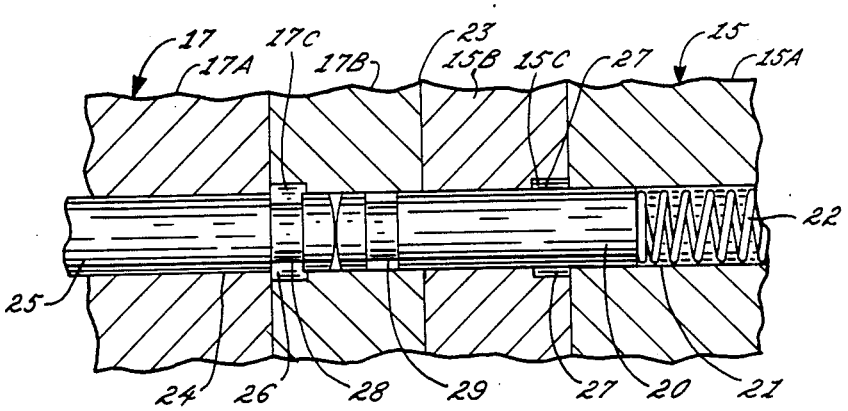
FIG. 4 is a magnified cross-sectional isolated view of the contact area between a driver and the corresponding tumbler pin and illustrating clearly the undercuts provided according to this invention.

When conventionally shaped driver pins and tumbler pins are used with such an undercut arrangement, the discontinuities provide a slight displacement of a driver or tumbler pin as the pin encounters the discontinuity during its axial motion. This effectively provides the false feel of a shear plane to a person attempting to pick the lock by feeling for the junction of the spindle and tumbler sleeve. This false feel effect is further accentuated, according to this invention, by providing annular grooves on the driver and tumbler pins. More specifically, as shown in FIG. 4, the driver pin 25 is provided with an annular groove 28 proximate to its end that cooperates with the tumbler pin 20. In addition, the tumbler pin 20 is also provided with a similar annular groove 29 on its end cooperating with the driver pin 25. As the driver pin 25 is moved axially inwards so as to push the tumbler pin 20 inwards against the pre-tensioning effect of the compression spring 22, the annular grooves 28 and 29 cooperate with the annular spindle undercut 26 so as to increase the extent of "give" between the pins and the bore discontinuity presented by the undercut 26, thereby giving the false impression that the shear plane 23 exists in the vicinity of the undercut 26. As the inward displacement of the driver pin 25 and tumbler pin 20 continues, the pin grooves 28 and 29 traverse the true shear plane 23 and subsequently interact with the tumbler undercut 27 to again increase the extent of "give" so as to provide a second false impression that the shear plane 23 lies in the vicinity of the undercut 27.

In the preferred embodiment, the annular grooves are provided on several of the driver pins as well as tumbler pins and the different lengths of the driver pins used to code the lock in effect cause grooves on the driver and tumbler pins to co-act with the undercuts on the spindle and the tumbler sleeve in such a manner that the false feel of the shear plane is provided at different inwardly extending positions of the driver and tumbler pins, thereby making it virtually impossible to determine exactly the true position of the shear plane.

According to a feature of this invention, the above type of lock construction incorporating the annular undercuts is simplified by constructing the driver sleeve and the tumbler sleeve as a combination of two separate parts, one conforming to the conventional cylindrical design and the other having a stepped diameter portion which defines the undercut in combination with the cylindrical portion. More specifically, the tumbler sleeve 15 is formed of a conventional cylindrical portion 15*a* and a generally cylindrical portion 15*b* which also includes a stepped annular portion 15*c* which defines the tumbler undercut 27 when positioned immediately adjacent the cylindrical portion 15*a*. In practice, the portion 15*b* of the tumbler sleeve which includes the stepped portion is permanently fixed to the cylindrical portion 15*a* by use of a strong industrial glue. Alternatively, the two tumbler sleeve portions may be joined together by a mechanical force-fit or other such arrangement. The above type of construction for the tumbler sleeve provides a simple and economical alternative to the expensive and possibly unfeasible molding or boring operations that would otherwise be necessary to define the annular undercut 27 inside an integrally formed tumbler sleeve. The stepped diameter design of the tumbler sleeve portion 15*b* can be formed by using conventional molding techniques so that the tumbler sleeve 15 can be economically constructed to include the undercut 27.

A similar type of construction is utilized for providing the spindle undercut 26. More specifically, the driver sleeve 16 is formed by the combination of a conventionally shaped cylindrical portion 17*a* and a substantially cylindrical portion 17*b* which includes a stepped section 17*c*, which, in combination with the cylindrical portion 17*a*, defines the spindle undercut 26 when the two portions 17*a* and 17*b* are joined together as shown.

Figure 5:
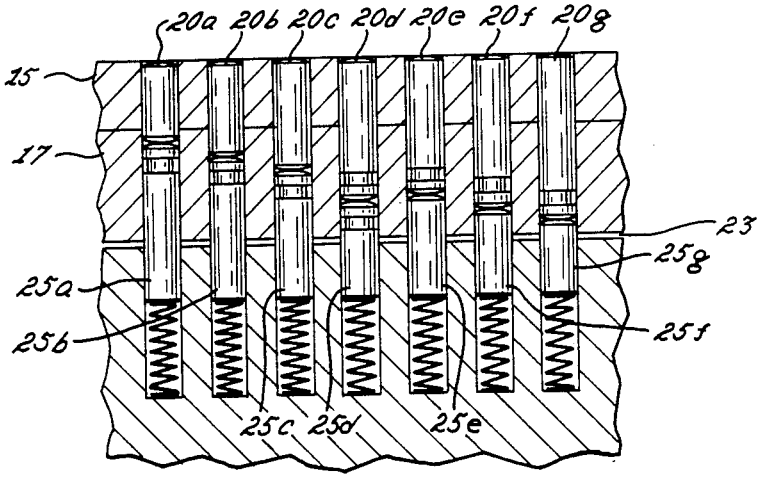
FIG. 5 is a cross-sectional view illustrating the disposition of a plurality of grooved pins according to this invention.

It will be apparent that varying combinations of grooved and ungrooved driver and tumbler pins maybe provided to prevent the false feel of the shear plane in a manner that appears seemingly random to a person attempting to pick or decode the lock. A typical example of one such combination is provided in FIG. 5, where driver pins 25*a*, 25*b*, 25*c* and 25*d* are provided with annular grooves whereas the remaining driving pins 25*e*, 25*f* and 25*g* are of conventional cylindrical shape. On the tumbler sleeve end, the tumbler pins 20*a*, 20*b* and 26*c* are of conventional cylindrical shape whereas the pins 20*d*, 20*e*, 20*f* and 20*g* are provided with the annular grooves It is preferable that at least one set of pins comprising a driver pin and the corresponding tumbler pin be provided with annular grooves on both the driver and the tumbler pins; for instance, in FIG. 5 the driver pin 25*d* and the corresponding tumbler pin 20*d* are both provided with annular grooves.

From the foregoing it is quite apparent that the present invention provides an improved tumbler lock construction which is highly resistant to picking attempts and is based on an uncomplicated locking mechanism which can be economically manufactured.

What is claimed is:

1. In a tubular lock construction comprising an outer barrel having forward and rear ends, a stationary tumbler sleeve telescoped into the rear end portion of said barrel, a locking spindle extending through and rotatably mounted in said stationary tumbler sleeve, a rotatable driver sleeve fixed to said spindle and disposed within said barrel in face-to-face relation with the forward end of said stationary tumbler sleeve and driver and tumbler pins slidably mounted in axially extending and angularly spaced holes defined in said stationary tumbler sleeve and said rotatable driver sleeve and normally operable to prevent rotation of said spindle with respect to said stationary tumbler sleeve, the improvement comprising annular undercuts provided in at least one of said tumbler sleeve and said driver sleeve so as to define annular discontinuities in the axially extending bores disposed therein, said tumbler sleeve and said driver sleeve each includes a uniformly cylindrical section and a substantially cylindrical section which includes a stepped section which defines said annular bore discontinuity when said sections are rigidly fixed together, and annular grooves defined on selected ones of said driver pins and said tumbler pins at their end proximate to the face-to-face junction of said tumbler sleeve and said driver sleeve, whereby said pin grooves interact with said annular sleeve undercuts to create a false impression of the existence of said face-to-face junction, as the pins are axially slided along said bores.

2. The tubular lock construction of claim 1 wherein said sleeve undercuts are defined about the respective ends of the driver and tumbler sleeves proximate to the face-to-face junction of the sleeves.

3. The tubular lock construction of claim 2 wherein said annular pin grooves are defined about the pin ends proximate to said face-to-face junction of said tumbler sleeve and said driver sleeve.

4. The tubular construction of claim 3 wherein at least one pair of pins comprising a selected driver pin and the corresponding tumbler pin is provided with the annular grooves.

5. The tubular construction of claim 1 wherein both said tumbler sleeve and said driver sleeve include an annular bore discontinuity portion to create a false impression of said face-to-face junction, and at least one of said tumbler sleeve and said driver sleeve includes a face-to-face junction portion to define the shear plane.

6. The tumbler construction of claim 1 wherein both said tumbler sleeve and said driver sleeve include an annular bore discontinuity portion to create a false impression of said face-to-face junction, and both said tumbler sleeve and said driver sleeve include a face-to-face junction portion to define the shear plane.

* * * * *